US005286459A

United States Patent [19]

Krismanth

[11] Patent Number: 5,286,459

[45] Date of Patent: Feb. 15, 1994

[54] MULTIPLE CHAMBER FUME INCINERATOR WITH HEAT RECOVERY

[75] Inventor: Kenneth A. Krismanth, Strongsville, Ohio

[73] Assignee: FECO Engineered Systems, Inc., Cleveland, Ohio

[21] Appl. No.: 923,099

[22] Filed: Jul. 30, 1992

[51] Int. Cl.[5] ..... B01D 50/00; F23G 7/06

[52] U.S. Cl. ..... 422/170; 422/173; 422/168; 110/210; 110/211; 110/244

[58] Field of Search ..... 422/168, 182, 173, 170; 110/210, 211, 204, 205, 213, 244; 431/5, 202

[56] References Cited

U.S. PATENT DOCUMENTS

| | | | |
|---|---|---|---|
| 3,251,656 | 7/1961 | Edwards | 422/173 |
| 3,353,919 | 11/1967 | Stockman | 422/176 |
| 3,607,118 | 9/1971 | Johnson | 422/182 |
| 3,706,445 | 12/1972 | Gentry | 422/198 |
| 3,870,474 | 3/1975 | Houston | 422/171 |
| 3,898,040 | 8/1975 | Tabak | 110/211 |
| 4,424,755 | 1/1984 | Caffyn et al. | 110/213 |
| 4,430,950 | 2/1984 | Foresto | 110/211 |
| 4,444,735 | 4/1984 | Birmingham et al. | 110/187 |
| 4,471,702 | 9/1984 | McKinlay | 110/211 |
| 4,481,889 | 11/1984 | Sikander et al. | 110/211 |
| 4,548,579 | 10/1985 | Cunningham | 110/211 |
| 4,616,572 | 10/1986 | Berthiller | 110/210 |
| 4,771,707 | 9/1988 | Robson et al. | 110/211 |
| 4,794,871 | 1/1989 | Schmidt et al. | 110/210 |
| 4,820,500 | 4/1989 | Obermüller | 110/210 |
| 4,878,839 | 11/1989 | Wunning | 110/211 |
| 4,941,415 | 7/1990 | Pope et al. | 110/211 |

*Primary Examiner*—Robert J. Warden
*Assistant Examiner*—Hien Tran
*Attorney, Agent, or Firm*—Renner, Otto, Boisselle & Sklar

[57] ABSTRACT

An energy efficient fume incinerator and method for eliminating fumes from a process gas stream while avoiding or minimizing the problem of build-up of organic or other constituents of the fume-laden process gas stream on the surfaces of the heat exchanger in which the fume-laden process gas stream is preheated. The fume incinerator and method are characterized by a first stage reaction chamber for preheating the process gas to a first temperature for preoxidizing organic constituents in the process gas, a second stage reaction chamber for heating the preheated process gas to a second temperature higher than said first temperature for incinerating the fumes; and a first stage heat exchanger for exchanging heat from the process gas exiting from the second stage reaction chamber to the preheated process gas passing from the first stage reaction chamber to the second stage reaction chamber.

20 Claims, 4 Drawing Sheets

MULTIPLE CHAMBER FUME INCINERATOR WITH HEAT RECOVERY

The invention herein described relates generally to the incineration of combustible fumes from a process gas stream and, more particularly, to a direct flame thermal oxidation system and method for eliminating combustible fumes from an oxygen bearing process gas stream before the process gas stream is vented to the atmosphere.

BACKGROUND

Fume incinerators heretofore have been used for eliminating combustible fumes from the off gases of various industrial processes. In one type of fume incinerator utilized for this purpose, commonly referred to as a thermal oxidizer, the process gas stream is oxygen bearing and serves as the source of oxygen for combusting an auxiliary fuel to establish a flame in which the combustible fumes are incinerated. Typically, the process gas stream is first preheated by being passed in heat exchange relationship with the combustion products of the thermal oxidizer as the process gas stream is being passed to the burner or burners of the thermal oxidizer. By preheating the process gas stream prior to combustion, the overall efficiency of the combustion process is increased and the amount of fuel consumed in the combustion of the process gas stream is reduced.

The fume-laden gases given off by some industrial processes contain volatile organic compounds (VOC's) and other organic constituents that tend to build up on the surfaces of the heat exchanger through which the fume-laden gases are passed before being passed to the burner or burners of the thermal oxidizer. This build-up progressively reduces the efficiency of the heat exchanger. Moreover, the heat exchanger passages may become clogged to a point that significantly restricts the flow of fume-laden gases. In the past this problem was solved by periodically removing the build-up from the heat exchanger passages. This not only was a tedious and time consuming task, but the thermal oxidizer necessarily had to be taken out of service to permit such cleaning operation. Unless a redundant thermal oxidizer was provided, shut down of the thermal oxidizer would normally necessitate shut down of the entire processing line, with obvious negative economic consequences.

SUMMARY OF THE INVENTION

The present invention provides an energy efficient fume incinerator and method for eliminating fumes from a process gas stream while avoiding or minimizing the problem of build-up of organic or other constituents of the fume-laden process gas stream on the surfaces of the heat exchanger in which the fume-laden process gas stream is preheated.

The fume incinerator and method are characterized by a first stage reaction chamber for preheating the process gas to a first temperature, a second stage reaction chamber for heating the preheated process gas to a second temperature higher than said first temperature; and a first stage heat exchanger for exchanging heat from the process gas exiting from the second stage reaction chamber to the preheated process gas passing from the first stage reaction chamber to the second stage reaction chamber.

When applied to eliminate combustible fumes from an oxygen bearing process gas stream, the first and second stage reaction chambers preferably are direct flame oxidation chambers of cyclonic type. Also, the first temperature preferably is at least about 800° F. for preoxidizing the VOC components and other organic constituents of the oxygen bearing process gas stream to prevent or minimize build up of such components and constituents in the first stage heat exchanger, whereas the second temperature is at least about 1400° F. for complete or substantially complete incineration of combustible fumes contained in the process gas.

According to a preferred embodiment of the invention, the incinerator and method are further characterized by a second stage heat exchanger for exchanging heat from the incinerated process gas exiting the first stage heat exchanger to another fluid. When the incinerator is used in combination with a process chamber such as a curing oven from which the process gas is exhausted to the first stage reaction chamber, the second stage heat exchanger may be used to preheat a gas, such as make-up air, supplied to the oven, thereby to further increase the energy efficiency of the overall system.

The foregoing and other features of the invention as hereinafter fully described and particularly pointed in the claims, the following description and the annexed drawings setting forth in detail a certain illustrated embodiment of the invention, this being indicative, however, of but one of the various ways in which the principles of the invention may be employed.

BRIEF DESCRIPTION OF THE DRAWINGS

In FIGS. 3-5, parts have been broken away for illustration purposes.

DETAILED DESCRIPTION

Figure 1:
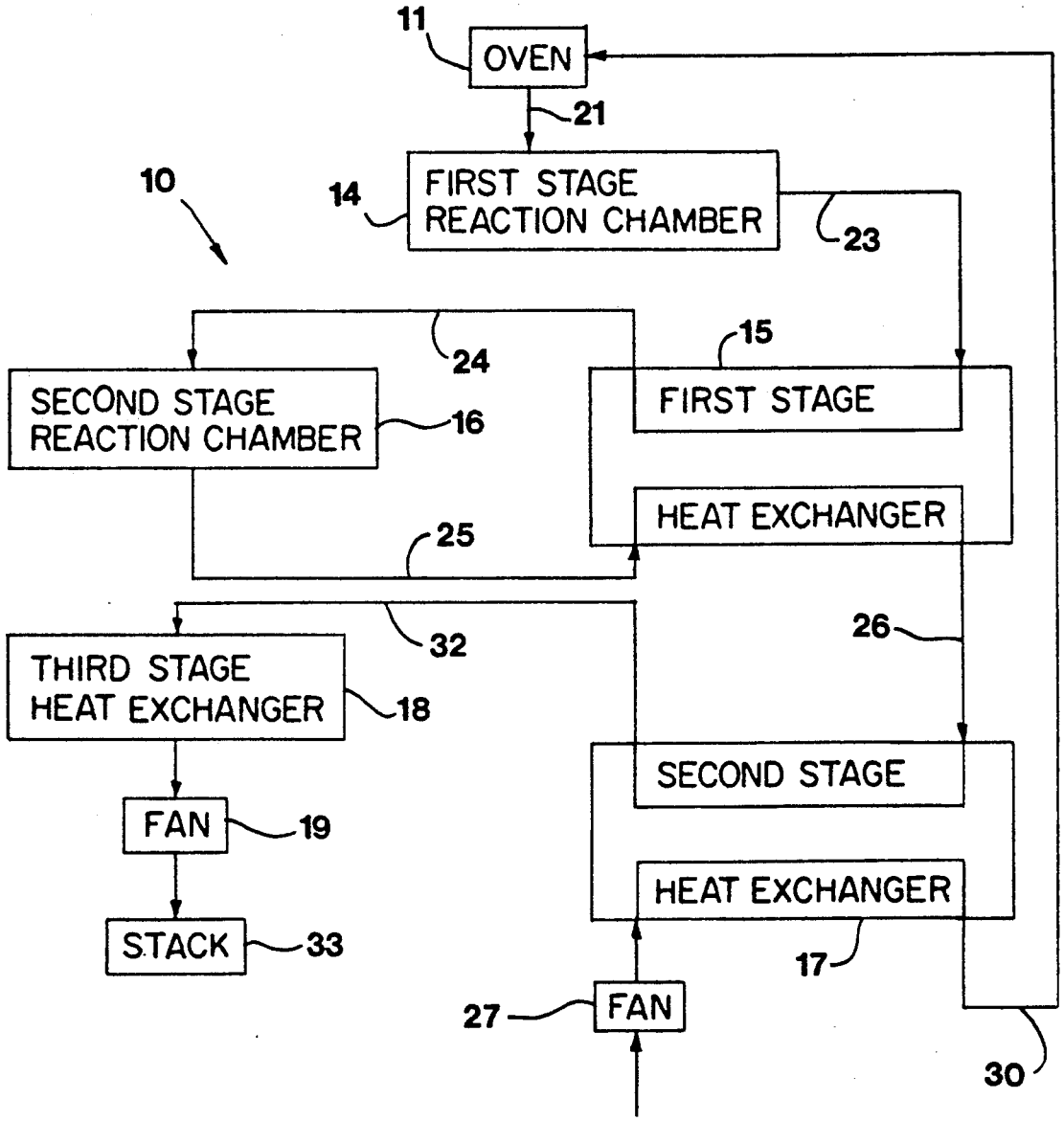
FIG. 1 is schematic illustration of an industrial process installation including an incinerator according to the present invention.
Figure 2:
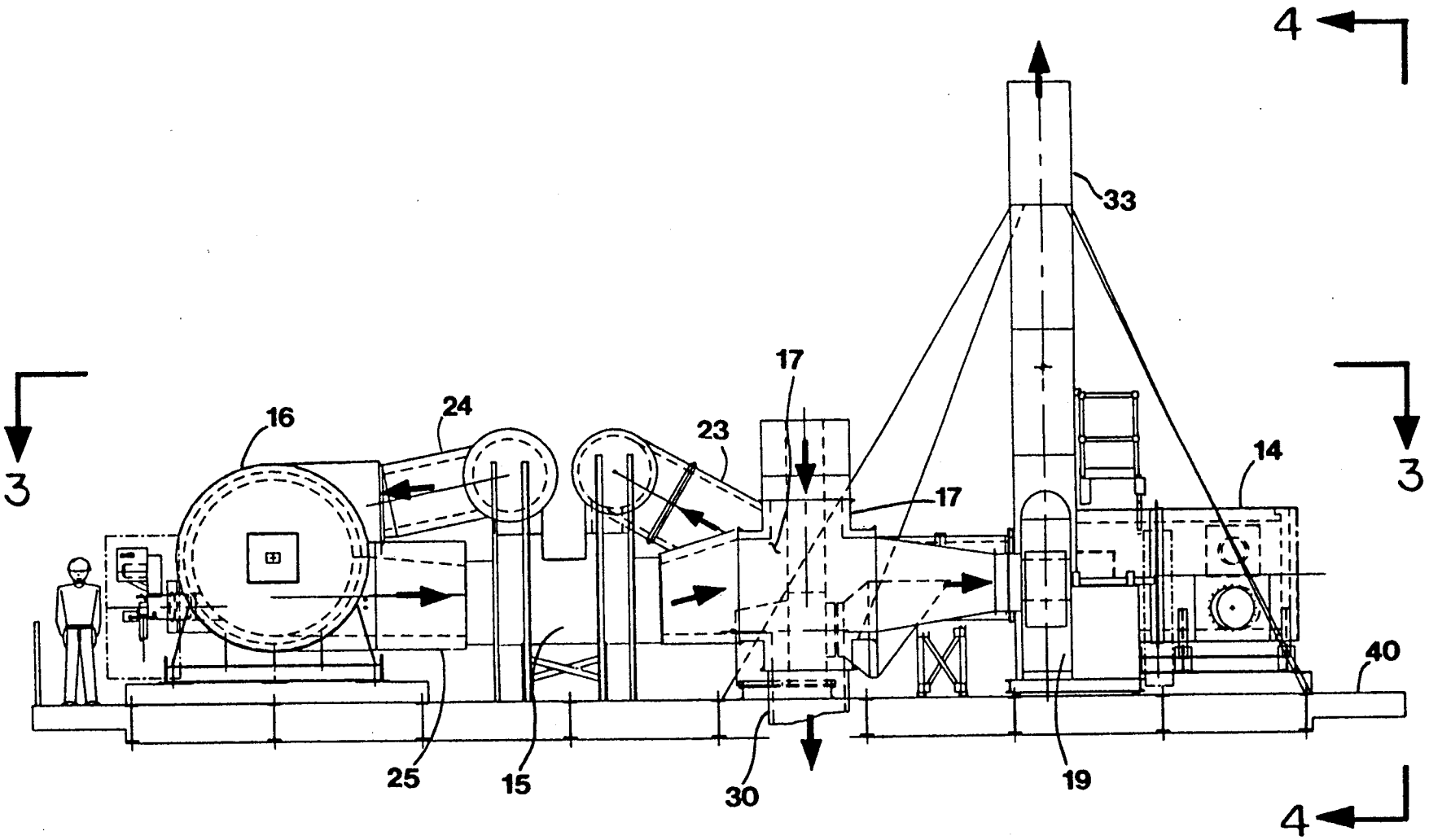
FIG. 2 is an elevational view of the incinerator according to the invention.
Figure 3:
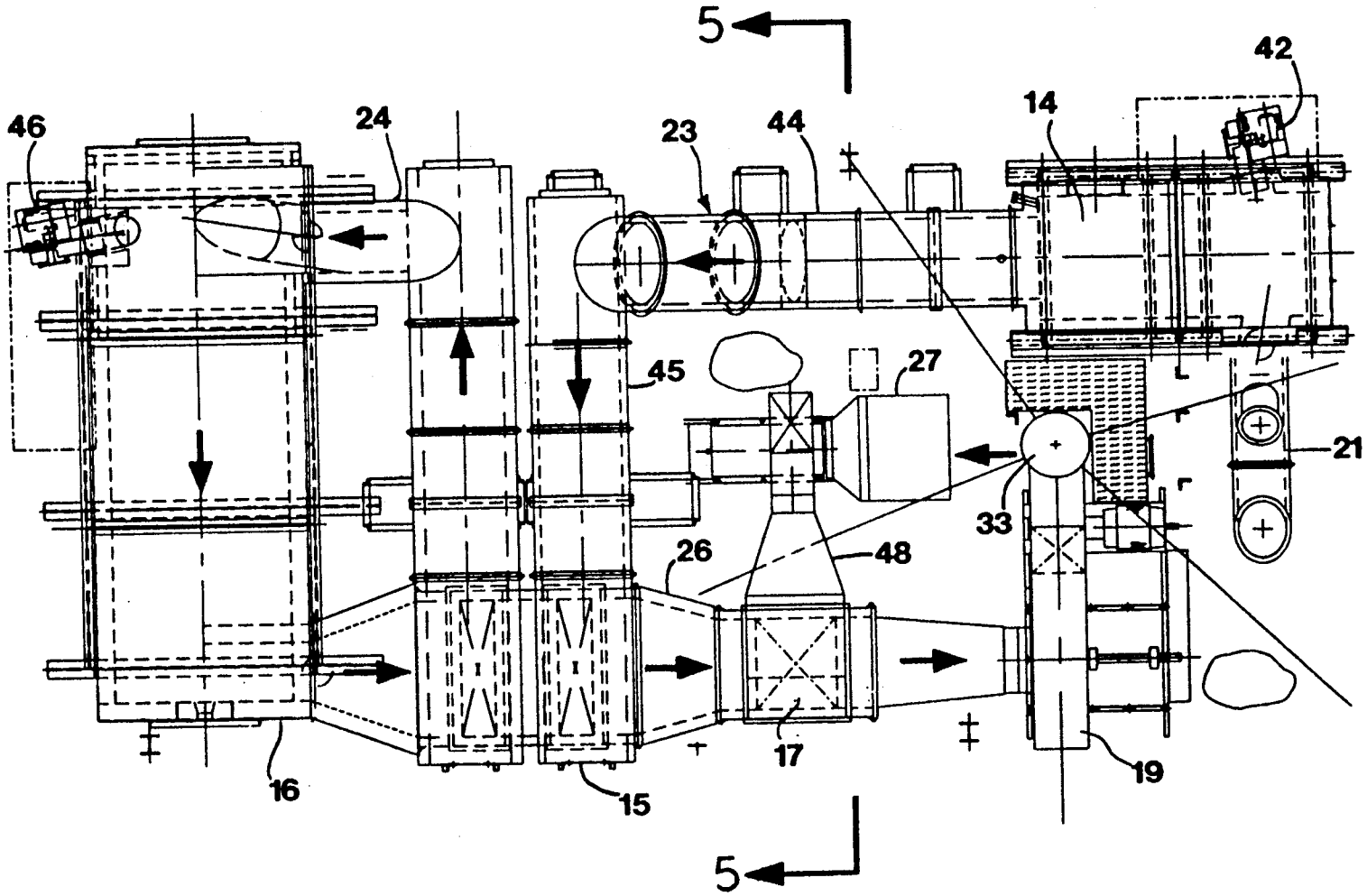
FIG. 3 is a top plan view of the incinerator looking from the line 3—3 of FIG. 2.
Figure 4:
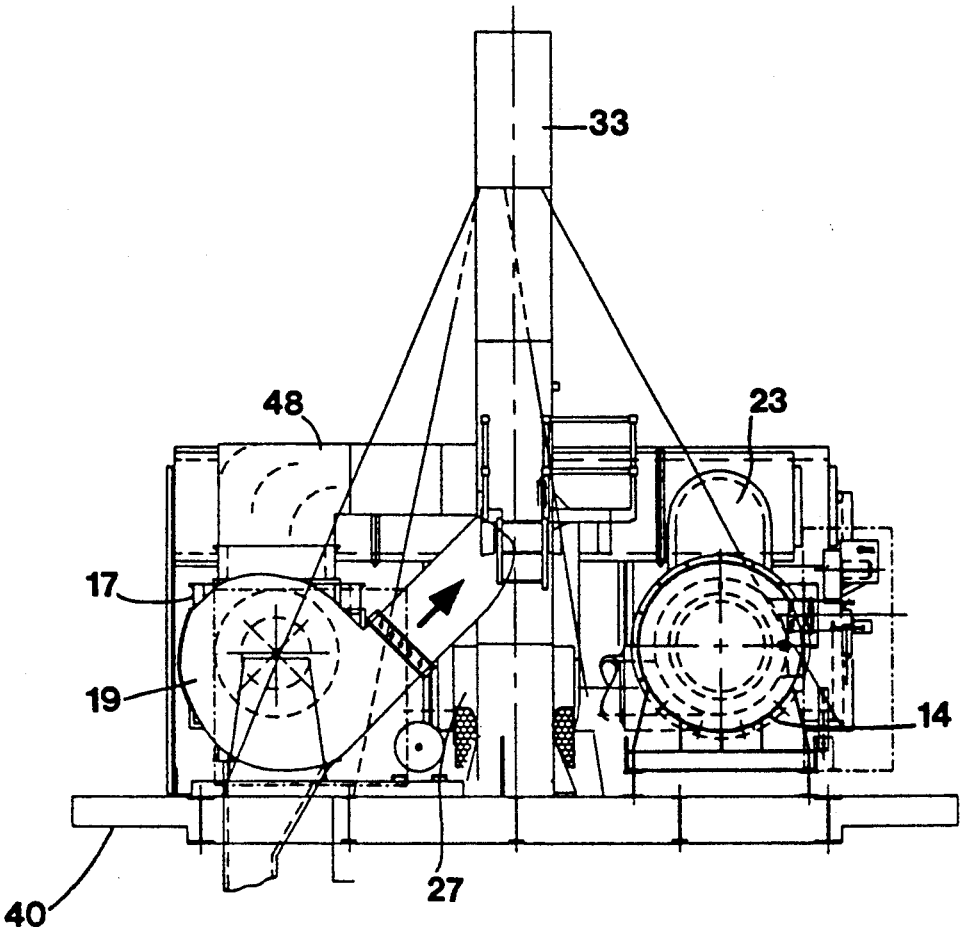
FIG. 4 is an end elevational view of the incinerator looking from the line 4—4 of FIG. 2.
Figure 5:
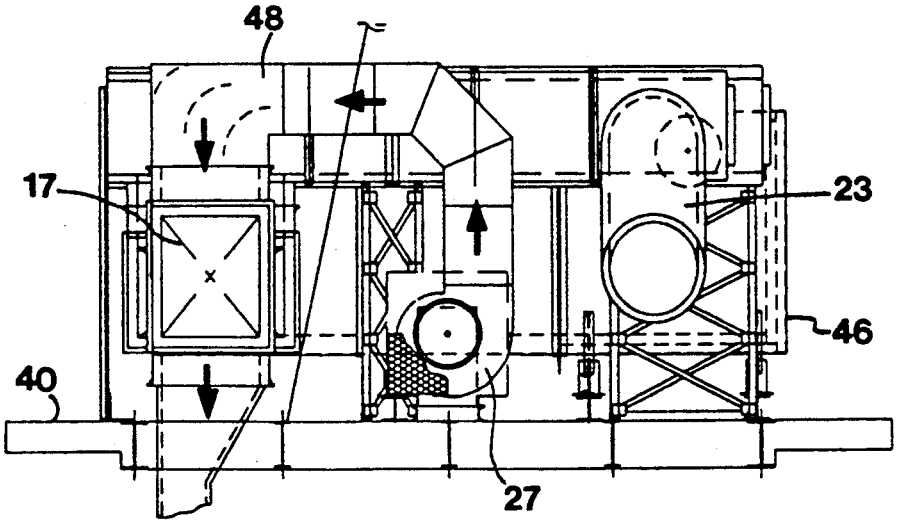
FIG. 5 is a cross-sectional view of the incinerator taken along the line 5—5 of FIG. 3.

Referring now in detail to the drawings, a fume incinerator 10 according to the invention is schematically illustrated in FIG. 1 while a preferred layout of the components of the incinerator is illustrated in FIGS. 2-5. Generally, the incinerator 10 will be part of an industrial system including a unit 11 which gives off noxious or other combustible fumes to be incinerated. By way of specific example, the unit 11 may be a thermal processing unit and more particularly a drying oven for coatings applied to cans wherein heated air as a process gas is passed through the oven to dry the coatings. During the drying process, the process gas becomes laden with fumes and, in particular, volatile organic compounds (VOC's) and other organic constituents that adhere to and coat surfaces with which they come into contact. The process gas containing the combustible fumes is exhausted to the incinerator 10 for incineration of the fumes before the process gas (air) is exhausted to the atmosphere.

As shown in FIG. 1, the incinerator 10 generally comprises a first stage reaction chamber 14, a second stage reaction chamber 16, a first stage heat exchanger 15, a second stage heat exchanger 17, a third stage heat exchanger 18 and an exhaust fan 19. In the illustrated embodiment the exhaust fan 19 functions as a draft fan for drawing the process gas through the incinerator, thereby maintaining a negative pressure within the incinerator.

The process gas stream exhausted by the oven 11 containing combustible fumes to be incinerated are fed via inlet duct 21 into the first stage reaction chamber 15 where the process gas is preheated. Preferably the process gas is preheated to a temperature in the range of 700°-900° F. and more preferably a temperature of about 800° F. to preoxidize the VOC's and other organic constituents thereby to obviate or minimize their tendency to coat surfaces such as metal heat exchanger surfaces. The first stage reaction chamber 14 preferably is a direct flame thermal oxidizer having a cyclonic flow pattern. Direct flame thermal oxidizers of this type are manufactured and sold by FECO Engineered Systems, Inc. of Cleveland, Ohio.

The preoxidized process gas stream is then passed via a duct 23 to the first stage heat exchanger 15 wherein the process gas is further preheated to a temperature higher than the temperature of the gas exiting the first stage reaction chamber. Preferably the process gas is heated in the first stage heat exchanger 15 to a temperature in the range of 1100°-1300° F. and more preferably about 1200° F. prior to its passing to the second stage reaction chamber 16 via a duct 24.

The second stage reaction chamber 16 is the main incineration area where the process gas is heated to a temperature sufficient to incinerate the fumes contained therein. Like the first stage reaction chamber 14, the second stage reaction chamber preferably is a direct flame thermal oxidizer having a cyclonic flow pattern. The temperature to which the process gas is heated and its residence time in the reaction chamber will depend on the pollutants being incinerated and often by governmental or industry regulations controlling the discharge of pollutants into the atmosphere. Typically, the gases will be heated to a temperature of between 1200° to 1500° F. with a residence time of about one half to two seconds to allow sufficient time for the oxidation of the hydrocarbons and other organic constituents in the process gas. More preferably the process gas is heated to a temperature of about 1400° F. with a residence time of about one second.

The incinerated process gas exiting the second stage reaction chamber 16 is passed through duct 25 to the first stage heat exchanger 15 where it is brought into indirect heat exchange relationship with the process gas stream being supplied to the second stage reaction chamber from the first stage reaction chamber so as to further preheat the preoxidized process gas stream being supplied to the second stage reaction chamber and cool the incinerated process gas. In the first stage heat exchanger 15 heat from the higher temperature process gas exiting the second stage reaction chamber will be transferred to the lower temperature process gas passing from the first stage reaction chamber to the second stage reaction chamber. As above indicated, the process gas passing from the first reaction chamber to the second stage reaction chamber is thusly further heated to a temperature of about 1200° F. prior to passage to the second stage reaction chamber.

The relatively cool incinerated process gas passes from the first stage heat exchanger 15 to a second stage heat exchanger 17 via a duct 26. In the illustrated system comprising the incinerator 10 and oven 11, the second stage heat exchanger 17 is used to heat make-up air being supplied to the oven 11. A fan 27 feeds fresh air into the second stage heat exchanger 17 for passage in indirect heat exchange relationship with the incinerated process gas stream exiting the first stage heat exchanger thereby to heat the air which is then supplied via duct 30 to the oven 11 for passage through the oven. At the same time, the incinerated process gas exiting the first stage heat exchanger is further cooled by the second stage heat exchanger. The fresh air supplied to the oven preferably is generally equal in volume to that which the oven would be exhausting to the incinerator during the drying process.

The incinerated process gas leaving the second stage heat exchanger 17 may still contain enough heat for further reclamation. In the illustrated FIG. 1 embodiment the incinerated process gas is passed by duct 32 to the third stage heat exchanger 18 which is a water heater. The process gas exiting the second stage heat exchanger is passed in indirect heat exchange relationship with water contained in the water heater 18 for heating the water. At the same time, the process gas passing through the water heater 18 is further cooled for venting to the atmosphere through a stack 33.

Having above described the major components and method operation of a preferred embodiment of fume incinerator according to the invention, reference may now be had to FIGS. 2-5 wherein the various components of the incinerator 10 are shown in a preferred arrangement. As shown, the various components of the incinerator are mounted to a platform 40 which may be elevated in relation to an oven associated therewith. The inlet duct 21 is connected to the first stage reaction chamber 14 which is a horizontally disposed, direct flame, cyclonic type thermal oxidizer. As shown, the thermal oxidizer has an externally mounted packaged burner 42.

The outlet of the first stage reaction chamber 14 is connected to the duct 23 which has a first leg 44 that extends initially horizontally and then upwardly to a second horizontal leg 45 extending transversely to the first leg 44 for connection to the first stage heat exchanger 15. The duct 24 extends from the first stage heat exchanger initially generally parallel to the horizontal leg 45 of the duct 23 and then transversely for connection to the second stage reaction chamber 16. The second stage reaction chamber is a horizontally disposed, direct flame, thermal oxidizer of cyclonic type having an externally mounted package burner 46. The outlet of the second stage reaction chamber is connected by duct 25 to the first stage heat exchanger 15 which in turn is connected by duct 26 to the second stage heat exchanger 17. As shown, the incinerated process gas leaving the second stage reaction chamber 16 travels along an essentially straight linear path to the first stage heat exchanger 15, then the second stage heat exchanger 17 and then to the fan 19 for venting to the atmosphere through stack 33. In the incinerator as shown in FIGS. 2-5, the third stage heat exchanger 18 has been omitted, but may be included between the second stage heat exchanger 17 and the fan 19.

The second stage heat exchanger 17 is connected by a duct 48 to the fan 27 which supplies fresh air for passage through the second stage heat exchanger in indirect heat exchange relationship with the incinerated process gas and then through a downwardly directed duct 30 to the oven 11.

Although the invention has been shown and described with respect to a preferred embodiment, it is obvious that equivalent alterations and modifications will occur to others skilled in the art upon the reading and understanding of this specification. The present invention includes all such equivalent alterations and modification, and is limited only by the scope of the following claims.

What is claimed is:

1. A fume incinerator for eliminating fumes from a process gas comprising a first stage reaction chamber for preheating a process gas to a first temperature;

a second stage reaction chamber for heating the preheated process gas to a second temperature higher than said first temperature; and a first stage heat exchanger for exchanging heat from the process gas exiting from said second stage reaction chamber to the preheated process gas passing from said first stage reaction chamber to said second stage reaction chamber independently of said first stage reaction chamber.

2. As incinerator as set forth in claim 1, wherein said first stage and second stage reaction chambers are direct flame oxidation chambers.

3. An incinerator as set forth in claim 2, wherein said first stage reaction chamber includes means for preheating the process gas to at least about 800° F. and said second stage reaction chamber includes means for heating the preheated process gas to at least about 1300° F.

4. An incinerator as set forth in claim 1, in combination with a thermal process chamber from which the process gas is exhausted, said incinerator further comprising a second stage heat exchanger for exchanging heat from the process gas exiting said first stage heat exchanger to a process gas supplied to said thermal process chamber.

5. A thermal oxidizer for eliminating combustible fumes from an oxygen bearing process gas comprising:

a first stage oxidation chamber for heating an oxygen bearing process gas to a first temperature for preoxidizing organic constituents in the process gas;

a second stage oxidation chamber for heating the preoxidized process gas to a second temperature higher than said first temperature; and a first stage heat exchanger for exchanging heat from the process gas exiting from said second stage oxidation chamber to the preoxidized process gas passing from said first stage oxidation chamber to said second stage oxidation chamber independently of said first stage oxidation chamber.

6. A thermal oxidizer as set forth in claim 5, wherein said first and second stage oxidation chambers are direct flame oxidation chambers.

7. A thermal oxidizer as set forth in claim 6, wherein said second stage oxidation chamber is a cyclonic oxidation chamber.

8. A thermal oxidizer as set forth in claim 7, wherein said first stage oxidation chamber is a cyclonic oxidation chamber.

9. A thermal oxidizer as set forth in claim 5, wherein said first stage oxidation chamber includes means for heating the process gas to a temperature in a range of 700° to 900° F. and said second stage oxidation chamber includes means for heating the preoxidized process gas to a temperature in a range of 1200° to 1500° F.

10. A thermal oxidizer as set forth in claim 9, wherein said first stage oxidation chamber includes means for heating the process gas to about 800° F. and said second stage oxidation chamber includes means for heating the preoxidized process gas to about 1400° F.

11. A thermal oxidizer as set forth in claim 5, further comprising a draft fan downstream of said first and second oxidation chambers and heat exchanger.

12. A system comprising a thermal process chamber and a thermal oxidizer for eliminating fumes from an oxygen bearing process gas exhausted by said thermal process chamber; said thermal oxidizer comprising a first stage oxidation chamber for heating the process gas to a first temperature for preoxidizing organic constituents in the process gas, a second stage oxidation chamber for heating the preoxidized process gas to a second temperature higher than said first temperature, and a first stage heat exchanger for exchanging heat from the process gas exiting from said second stage oxidation chamber to the preoxidized process gas passing from said first stage oxidation chamber to said second stage oxidation chamber independently of said first stage oxidation chamber.

13. A system as set forth in claim 12, wherein said thermal oxidizer further comprises a second stage heat exchanger for exchanging heat from the process gas exiting said first stage heat exchanger to a process gas supplied to said thermal process chamber.

14. An incineration method for eliminating fumes from a process gas comprising the steps of:

preheating a process gas in a first stage reaction chamber to a first temperature;

heating the preheated process gas in a second stage reaction chamber to a second temperature higher than the first temperature; and exchanging, in a first stage heat exchanger, heat from the process gas exiting from said second stage reaction chamber to the preheated process gas passing from said first stage reaction chamber to said second stage reaction chamber independently of said first stage reaction chamber.

15. An incineration method as set forth in claim 14, wherein said preheating step includes exposing the process gas to a direct flame in the first stage reaction chamber and said heating step includes exposing the process gas to a direct flame in the second stage reaction chamber.

16. An incineration method as set forth in claim 14, wherein said first temperature is at least about 800° F. and said second temperature is at least about 1300° F.

17. An incineration method as set forth in claim 14, comprising the steps of:

directing the process gas from a thermal process chamber to the first stage reaction chamber for preheating, and exchanging, in a second stage heat exchanger, heat from the process gas exiting the first stage heat exchanger to a process gas supplied to the thermal process chamber.

18. An incineration method as set forth in claim 14, for eliminating combustible fumes from an oxygen bearing process gas, wherein the preheating step includes heating the process gas to a first temperature for preoxidizing organic constituents in the process gas, and the heating step includes heating the preoxidized process gas to a second temperature higher than the first temperature.

19. An incineration method as set forth in claim 18, wherein said preheating and heating steps include exposing the process gas to direct flame in first and second stage oxidation chambers.

20. An incineration method as set forth in claim 19, wherein the first and second stage oxidation chambers are cyclonic oxidation chambers.

* * * * *